United States Patent [19]

Kuehnle et al.

[11] Patent Number: 4,848,008

[45] Date of Patent: Jul. 18, 1989

[54] THERAPEUTIC SHOCK-ABSORBING SHOES

[76] Inventors: Manfred R. Kuehnle, Rte. 103A, New London, N.H. 03257; Vidala J. Senftner, 7208 Benton Dr., Des Moines, Iowa 50322

[21] Appl. No.: 62,080

[22] Filed: Jun. 15, 1987

[51] Int. Cl.[4] ..... A43B 21/26; A43B 21/47

[52] U.S. Cl. ..... 36/35 R; 36/36 R; 36/37

[58] Field of Search ..... 36/27, 34 R, 35 R, 35 A, 36/35 B, 36 R, 37, 71, 38

[56] References Cited

U.S. PATENT DOCUMENTS

| | | | |
|---|---|---|---|
| 380,508 | 4/1888 | Munger | 36/36 R |
| 1,356,829 | 10/1920 | Rohmer | 36/37 |
| 1,667,386 | 4/1928 | Ketcham | 36/35 R |
| 1,780,997 | 11/1930 | Cohan et al. | 36/37 |
| 2,807,100 | 9/1957 | Windle | 36/35 R |
| 3,043,024 | 7/1962 | Haug, Jr. | 36/36 R |
| 3,174,235 | 3/1965 | Johnston | 36/36 R |
| 4,631,841 | 12/1986 | Hickey | 36/71 |

FOREIGN PATENT DOCUMENTS

| | | | |
|---|---|---|---|
| 865415 | 4/1961 | United Kingdom | 36/36 R |

*Primary Examiner*—Steven N. Meyers

*Attorney, Agent, or Firm*—Nutter, McClennen & Fish

[57] ABSTRACT

Women's high heel shoes and men's shoes are provided with unidirectionally compressible resilient heels and internal cushioning pads that absorb shock forces when the shoes are worn while walking, thereby reducing stress on the wearer's feet and legs and on the shoe heels themselves. The stiffness or compliance of the heels can be selected or adjusted to suit the wishes of the wearer.

11 Claims, 2 Drawing Sheets

THERAPEUTIC SHOCK-ABSORBING SHOES

This invention relates to footwear. It relates more particularly to women's high-heel shoes, and men's shoes.

BACKGROUND OF THE INVENTION

Women's shoes often have high heels or spike heels of various heights and thicknesses. It is estimated that as many as 59% of all women in the United States wear them regularly because they consider them preferable and more fashionable than flats or shoes with lower heels. However, a recent Gallop survey also shows that among these high-heel shoe wearers, 62% have foot pain, blisters, bunions, corns, calluses or other foot problems. Undoubtedly, as a result, the same survey shows that slightly more than half of those women wear high-heel shoes less often than they did five years ago. We believe that these foot problems are, to a large extent, due to the excessive omnidirectional shock forces that are routinely transmitted through the ball and heel portions of the wearer's feet into the spine when she walks wearing a pair of these shoes.

More particularly, when one walks barefoot or in flats, the heel and ball of the foot are more or less in the same plane. With each stride, the heel strikes the floor first followed by the ball of the foot and then the toes in a progressive rolling motion. Also, there is relatively large-area contact between the foot and the floor at any given time and little possibility to twist an ankle because the heel bone serves effectively as the unidirectional "heel". As a result, there is a smaller impulse and shock force imparted to the foot each time the foot strikes the floor. A typical high heel shoe, on the other hand, has a heel that is 2–3 inches long. This means that the heel portion of the wear's foot is supported 2–3 inches above the ball and toe portions of the foot that rest on the sole of the shoe. Accordingly, when a woman walks in a pair of high heels, although the heel of each shoe strikes the floor first, there is no progressive rolling motion of the foot as described above. Rather, the foot approaches the floor more vertically, with the heel and sole of the shoe striking the floor almost simultaneously. There is very little redirecting and dissipating of those impact forces as occurs when one wears low heel shoes or flats. At most, the heel may have a lift on top on its lower end that is somewhat resilient, but this lift frequently becomes worn away after a relatively short period of time. Resultantly, each time the wearer steps out, a very strong impulse is transmitted without any directional control via the heel and ball portions of the wearer's foot directly to her ankle and leg sending shock forces in any direction through the shoe structure, thus making foot injuries possible.

Also, it is a fact that most high heel shoes, particularly the more fashionable ones, have heels whose ends are quite narrow, i.e. of small area. Consequently, all of the reaction forces developed as a result of the wearer's weight and momentum while walking are concentrated primarily in the narrow heel area of the shoe.

Furthermore, the fixed incline of the shoe at the arch required to position the heel and ball portions of the wearer's foot at such different elevations mandates that the area of the shoe sole underlying the ball portion also have a relatively small area. Therefore, the shock forces produced by each footfall are concentrated also on that part of the wearer's foot and propagated from there into the spine where the shock energy is dissipated in the spinal discs. This stress on the ball of the foot is exacerbated because as soon as the sole of the shoe strikes the floor, the wearer's foot tends to slide down the inclined arch of the shoe so that the ball of the foot impacts the bottom of the shoe, while the toes are jammed against the toe and vamp of the shoe. All of these dynamic effects undoubtedly contribute to the spinal problems and foot problems mentioned at the outset, as well as to ankle pain and leg fatigue suffered by many women who have to walk long distances during the course of their day.

Also, of course, the forces concentrated in the heel area of a woman's high heel shoe worn while walking also causes great stress on the heel itself, particularly at the narrow end thereof. Sometimes the heel becomes bent or deformed; in extreme cases, the end of the heel actually breaks off.

Men's shoes, in contrast, are not as painful to wear as women's high-heeled shoes, but men's shoes with hard heels impart the same shock forces into the spine and the foot bone structure so as to cause similar medical problems for men.

SUMMARY OF THE INVENTION

Accordingly the present invention aims to provide a therapeutic woman's high heel shoe and men's flat heel shoe.

Another object of the invention is to provide shoes which minimize shock forces to the spine and reduce stress on the wearer's feet at the heels, the arches, and the toes.

Yet another object of the invention is to provide a shoe which reduces the incidence of foot fatigue and trauma caused by walking.

Still another object of the invention is to provide such a shoe which is relatively easy to manufacture.

A further object of the invention is to incorporate an easy-to-manufacture resilient mechanism into a shoe heel which is protected from dirt, water, and other contaminants.

Yet another object is to provide a shoe which reduces localized stresses on the heel portions of the shoe.

Another object is to provide a heel for a shoe which dissipates shock forces caused by walking, yet is wear-resistant.

A further object of the invention is to provide a shoe heel whose shock force-dissipating characteristics are adjustable or variable according to the weight and desire of the wearer.

Other objects will, in part, be obvious and will, in part, appear hereinafter. The invention accordingly comprises the features of construction, combination of elements, and arrangement of parts which will be exemplified in the following detailed description, and the scope of the invention will be indicated in the claims.

Briefly, in accordance with our invention, a shoe is provided with a heel which controls the direction of the shock forces imparted to the shoe when the heel contacts the ground during walking and which, in a unidirectional way, dissipates the shock energy within the shoe. In this, the usual heel functions, i.e. as a wear surface and as a shock absorber, are separated or divided in the heel structure so that the heel as a whole provides optimum resilience or stiffness for the particular wearer and optimum wear-resistance, skid-resistance, etc. at the heel surface which contacts the ground.

Thus, our heel structure includes a wear-resistance member which provides the contact interface between the heel and the walking surface, a resilient member between the wear-resistant member and the remainder of the heel and a unidirectional guidance mechanism which confines the motion of the wear-resistance member to movements toward and away from the remainder of the heel. As will be described in more detail presently, our heel may also include provision for varying or selecting the stiffness or resilience of the heel to suit a particular wearer's weight or gait and insignia or indicia to distinguish the heel from a conventional heel structure. While the invention has particular application to women's high heel shoes, it may also be incorporated into the heels of mens' shoes.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
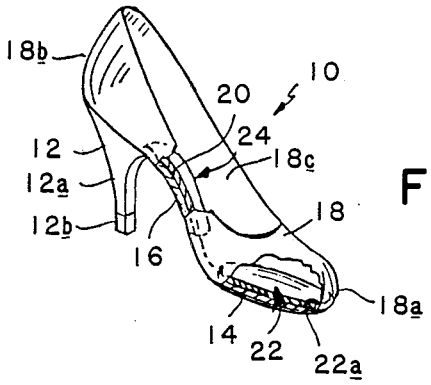
FIG. 1 is a perspective view with parts broken away showing a woman's shoe incorporating our invention.

Referring to FIG. 1 of the drawings, a woman's shoe shown generally at 10 has a heel 12 and a sole 14 connected by a relatively steeply inclined arch 16. The bottom parts (i.e. sole and heel) of the shoe are attached to a lasted shoe upper 18 having a tip or toe **18*a* and a rear counter 18*b*, the opposite sides 18*c* of the upper extending in a continuous fashion from the counter to the vamp or arch strap. The shoe upper can be made of any conventional material such as leather or fabric. Likewise, the shoe sole and heel can be made of a variety of materials commonly used for those purposes and covered by a suitable innersole 20**.

Positioned on the shoe innersole 20 at the front of the shoe is a shock-absorbing pad 22. Pad 22 is cemented to the shoe innersole 20 and it covers the area of the shoe that supports the ball of the wearer's foot and her toes. Preferably, the front edge margin **22*a* of the pad extends a short distance up the inside surface of the shoe toe 18*a* so that when the shoe is worn, part of that pad lies between the tips of the wearer's toes and the toe of the shoe. A second similar pad 24 is cemented to the shoe innersole in the region of the inclined shoe arch 16**.

The pads 22 and 24 may be made of any suitable cushioning or shock-absorbing material. A particularly appropriate pad is composed of an ultralight material called nylon Tri-Lock available from Laurel Industrial Textiles, Inc., Skowhegan, Maine. This intricate woven material has been used as a lining for astronauts' boots. The material resembles corregated paperboard in that it has rows of tubes sandwiched between two flat surfaces. However, the entire structure is actually woven from a blend of nylon, polyethelene and polyester filaments. These filaments are arranged in a urethane foam-encapsulated interlocking figure-8 pattern that is particularly effective in dispersing shock forces throughout the structure, making the pad very resistent to crushing and deformation.

Figure 2:
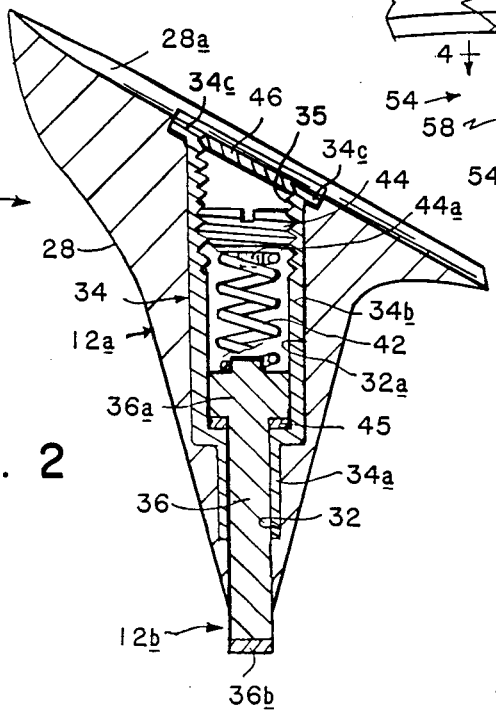
FIG. 2 is a fragmentary sectional view on a much larger scale showing the heel portion of the FIG. 1 shoe in greater detail.

Referring now to FIG. 2, the heel 12 of the shoe comprises an upper section **12*a* and a lower section 12*b*. Section 12*a* comprises a block 28 of conventional heel material such as wood or plastic and it is covered in the usual way with a leather or fabric material so that it matches the shoe upper. Block 28 may have any desired heel shape. Typically its upper end is angled and provided with a flat surface 28*a* and it tapers down to a lower end 28*b*** having a relatively small, generally square cross-section.

Unlike a conventional shoe heel, block 28 is provided with a vertical passage 32 that extends the entire length of the block from surface **28*a* to the block lower end 28*b*. The passage has a generally square cross section and is provided with a counterbore 32*a* that extends from surface 28*a* approximately one-third to one-half the length of the block. Seated in passage 32 is a rigid molded plastic tubular insert sleeve 34. Sleeve 34 has a lower section 34*a* with a square cross section that fits snugly in passage 32 and an upper section 34*b* that fits snugly in counterbore 32*a*. In addition, as shown in FIG. 2, the upper end segment of sleeve section 34*b* is interiorly threaded at 35. The sleeve is topped off by a flange 34*c* that is angled so that when the sleeve is seated in passage 32, flange 34*c* lies flush against block surface 28*a*. The sleeve is anchored to block 28** by a suitable cement or adhesive.

The lower heel section **12*b* is connected telescopically or unidirectionally to block 28, or more particularly to sleeve 34 and it extends a short distance below the block lower end 28*b*. Section 12*b* actually comprises a relatively long bar or block 36 made of a suitable rigid material such as wood, plastic or metal. The square cross-sectional dimensions of bar 36 permit it to be slidably received in sleeve section 34*a* with a relatively snug fit. A flange 36*a* is provided adjacent to the upper end of bar 36 which is sized to be slidably received in the sleeve section 34*b* and the lower end of bar 36 is provided with a conventional heel tap or lift 36*b*. When bar 36 is inserted into sleeve 34 from above, it will slide along that sleeve until its flange 36*a* bottoms in sleeve section 34*b*. The length of the bar 36 is such that a lower end segment of the bar, approximately ¼ inch long, projects below the tapered block lower end 28*b*. That protruding length of bar 36, which constitutes the exposed heel lower section 12*b*, may be colored or covered to match the exterior of section 12*a*** so that the boundary between the two sections is hardly visible.

Still referring to FIG. 2, a relatively stiff coil spring 42 is positioned in sleeve section **34*b*, with the lower end of the spring resting on the bar flange 36*a*. A set screw 44, provided with a small boss 44*a* on its lower surface, is turned down into the threaded segment 35 of sleeve section 34*b* so as to capture and compress spring 42 between the set screw and bar 36. The compressed spring 42 thus exerts a force on bar 36 tending to maintain the bar in its fully extended position shown in FIG. 2 wherein the bar flange 36*a* bottoms in sleeve section 34*b***. Preferably, a shock-absorbing or resilient washer 45 is provided at the bottom of section 34b to provide a cushion when bar 36 bottoms in its extended position.

A snap-in cap 46 is seated in the thread 35 at the upper end of the sleeve 34 to close the upper end of that tubular member. The cap is angled to correspond with the sleeve flange 34c so that when the cap is in place, its exposed surface is flush with the surface of flange 34c. The removable cap 46 gives access to screw 44 to permit a spring of the proper stiffness to be inserted into heel 12. That is, a heavier person would usually want a stiffer spring. Alternatively, if the spring 42 has a nonlinear spring characteristic or rate, the wearer can adjust the bias on heel section 12b to suit her preference by turning screw 44 in one direction or the other.

It is apparent that when one walks in shoes 10, the elastic and resilient heel 12 "gives" unidirectionally and cushions the shock forces caused by the shoe heel impacting the floor. As noted above, the degree of heel resilience can be adjusted to suit the wearer by proper selection of spring 42 and/or adjustment of screw 44.

When walking in shoes 10, as soon as the heel 12 strikes the floor, the toe of the shoe follows. However, the pads 22 and 24 cushion the ball and arch portions of wearer's foot against the shock forces caused by the sole of the shoe impacting the ground. Furthermore, those pads, which have a rough texture, tend to prevent the wearer's foot from sliding forwardly and downwardly in the shoe. This further minimizes stress on the ball of the foot and reduces the liklihood of the wearer's toes being jammed against the toe of the shoe. Thus the resilient heel 12 and cushioning pads 22 and 24 all combine and coact to dissipate the forces caused by the heel and shoe impacting the walking surface. This reduces considerably the incidence of stress and trauma on a woman's feet and legs as she walks in a pair of high heel shoes.

The dissipating of the impacting forces by the heel 12 also minimizes localized stresses on the heel structure itself. Therefore, there is less tendency for heel 12 to deform, bend or break, particularly at its narrower lower end. Also, the fact that heel 12 relies on its internal, resilient, unidirectional guidance mechanism to provide its entire shock-absorbing capability means that the material of the heel lift 36b can be selected solely on the basis of its wear-resistance characteristics.

In other words, in a conventional shoe, the heel part that contacts the ground is usually designed or selected to provide both a shock absorber and a wear surface. Since these requirements are mutually antagonistic, there usually results a compromise in the selection of the heel end or lift material so that the lift has less than optimum resilience and less than optimum wearability. In contrast, in accordance with our invention, the lift or heel end that contacts the ground is not relied upon the provide any shock-absorbing function at all; therefore, the lift can be chosen or designed to provide maximum durability, wearability, skid-resistance and the like. Likewise, the completely separate shock-absorbing and guidance mechanism in the heel can be tailored specifically to suit the wearer in terms of compliance, resilience or stiffness, taking into consideration the wearer's weight and walking characteristics.

Figure 3:
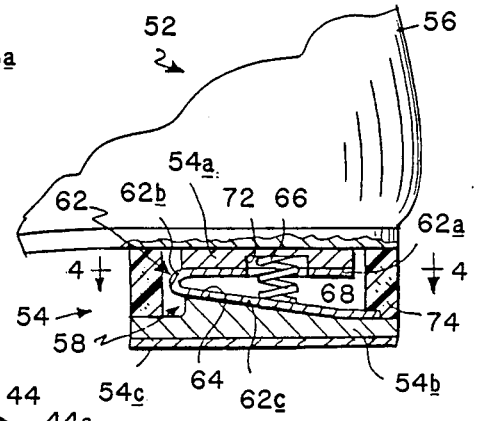
FIG. 3 is a fragmentary side elevational view with parts in section showing the invention incorporated into a man's shoe.
Figure 4:
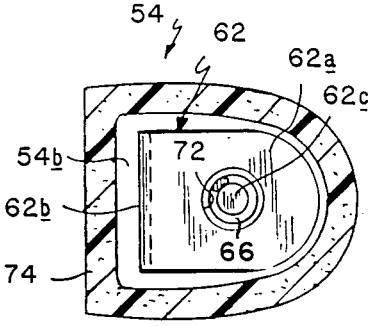
FIG. 4 is a sectional view taken along line 4—4 of FIG. 3.

Refer now to FIGS. 3 and 4 which show in invention incorporated into a man's shoe. The shoe, shown generally at 52, has a heel 54 composed of a plate-like upper section 54a attached to the underside of the shoe upper 56 at the rear of the shoe. The heel also includes a lower section 54b having the outline of a conventional heel and that section may be fitted with a standard heel tap 54c to minimize heel wear.

Heel section 54b is connected to heel section 54a by a resilient, unidirectionally compressible mechanism shown generally at 58 which is situated entirely within heel 54. Mechanism 58 includes a relatively stiff V-shaped leaf spring 62 having an upper plate or arm 62a secured by screws or the like (not shown) flush against the underside of heel section 54a. The spring is turned back on itself at a hinge line 62b at the front of the heel so that the spring lower plate or arm 62c extends rearwardly below arm 62a.

The upper surface 64 of heel section 54b has a rear-to-front incline or ramp and spring arm 62c is shaped to lie flat against that surface so that when the two are secured together by screws or the like (not shown), the spring will confine the heel section 54b to unidirectional movement toward and away from heel section 54a with essentially no lateral motion or cocking or tilting of heel section 54b. With the shape of spring 62 preset, the spring will tend to maintain a fixed spacing between the two heel sections, but will allow the heel to be compressed elastically and unidirectionally to cushion shocks due to impacts of the heel against the ground, thereby providing the benefits described above for shoe 10.

Preferably, a coil spring 66 is also included in heel 54 as part of mechanism 58 to increase the stiffness of that mechanism. In the illustrated shoe 52, one end of spring 66 is seated in a recess 68 in the underside of heel section 54a and the spring extends through a clearance hole 72 in leaf spring arm 62a so that the opposite end of spring 66 can bear against leaf spring arm 62c. Thus, spring 66 exerts restoring force only when heel 54 is compressed under a load. This spring can be selected so that its spring constant or stiffness is appropriate for the particular wearer's weight and walking characteristics.

An annular compressible or elastically stretchable, appropriately colored filler member or cover 74 is secured between heel sections 54a and 54b at their peripheries to close the space between those sections not only for aesthetic reasons, but more importantly to exclude dirt and moisture from the heel space containing mechanism 58. This helps to assure that heel 54 will operate properly for the useful life of the shoe 52.

Figure 5:
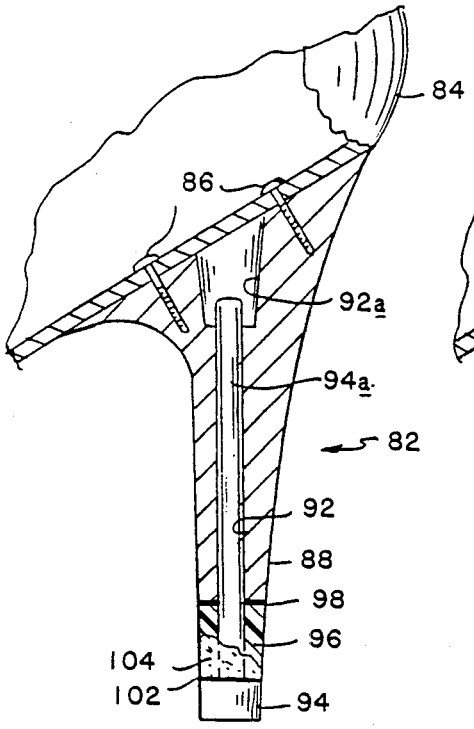
FIG. 5 is a sectional view with parts in elevation of another invention embodiment.

FIG. 5 illustrates still another embodiment of our invention. In this case, the heel, shown generally at 82, is mounted to the underside of the shoe upper 84 by means of nails 86 which extend down through the bottom of the upper into the top of the heel. Heel 82 comprises a conventionally profiled heel block 88. The block is formed with an axial passage 92 which extends the entire length of the block, the upper end of that passage being counterbored at 92a. A heel lift 94 made of a suitable wear-resistant material is positioned at the underside of block 88. The lift has an integral stem or shaft 94a which is snugly received in the block passage 92 so that the motion of the lift is confined to unidirectional movements along the axis of passage 92. Encircling shaft 94a between lift 94 and the bottom surface of block 88 is a generally cylindrical compressive and elastic or resilient member 96 (which could also be a coil spring). The upper surface of member 96 is bonded at 98 to the bottom surface of block 88 and the lower surface of member 96 is connected to lift 94 by a similar bond 102.

Thus, in heel 82, the resilient member 96 coupled with the unidirectional guidance mechanism 92, 94a enables heel 82 to distribute the shock forces caused by walking in shoe 82, thereby producing all of the benefits described above. Furthermore, since the lift 94 that contacts the walking surface plays no part in the shock-absorbing function of the heel, it can be made of a material selected solely on the basis of its abrasion-resistance, skid-resistance and the like characteristics. Likewise, member 96 which never contacts the walking surface can be selected solely on the basis of a stiffness or spring characteristic that will best suit the needs of the wearer of the shoe incorporating heel 82. In other words, a heavier person or a person who impacts the ground when she steps out while walking would normally prefer a stiffer member 96, whereas a lighter individual would desire a less stiff or more compliant member 96.

Actually, a shoe with a heel 82 can be sold with a plurality of resilient members 96 of different stiffnesses which have peel and stick adhesive layers at their upper and lower ends. The purchaser can try the different members 96 without removing the backing strips from the adhesive layers. When she finds the one with the proper compressibility, she can remove the backing strips from that one and position it as shown in FIG. 5 so that it bonds or adheres to the opposing surfaces of block 88 and lift 94 thereby anchoring the lift to the block, but permitting the unidirectional elastic relative motion described above.

As with the other heels described previously, the exterior surface of the compliant member 96 can be colored and shaped to match block 88 and lift 94. Alternatively, if desired, the outer surface of that member can be provided with indicium or an insignia such as a contrasting-color surface coating indicated at 104 to identify heel 82 as one incorporating this invention and to distinguish it from conventional therapeutic or non-therapeutic heels which do not have the structure or capabilities described herein.

Figure 6:
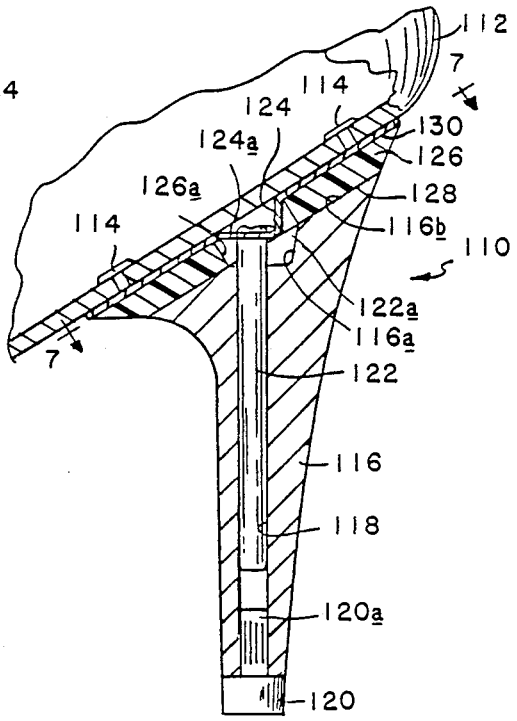
FIG. 6 is a similar view of still another invention embodiment.
Figure 7:
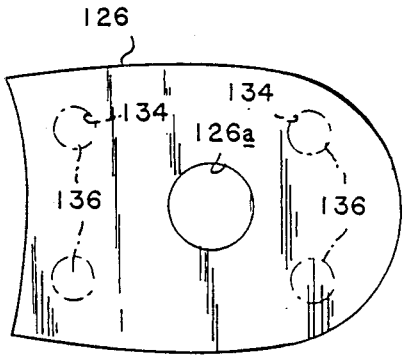
FIG. 7 is a sectional view taken along line 7—7 of FIG. 6.

Refer now to FIGS. 6 and 7 which depict generally at 110 still another heel embodiment that incorporates our invention. In this case, heel 110 is mounted to the underside of the shoe upper 112 by means of rivets 114 which project from the top of the heel through appropriate openings in the bottom of the shoe upper, with the rivet heads being flattened so that they do not hurt the wearer's foot. An innersole (not shown) may be provided to physically isolate the rivet heads.

Heel 110 comprises a rigid, suitably shaped heel block 116 having an axial passage 118 which extends from one end of the block to the other. Positioned at the lower end of passage 118 is the stem **120*a* of a wear-resistant heel lift or tap 120. The lift 120 and its stem 120*a* can be permanently secured in the passage by an appropriate cement or adhesive. Snugly, but slidably, received in the opposite end of passage 118, is a stem or shaft 122 which projects down from a heel plate 124. The rivets 114 described above originate at that heel plate and when the rivets are anchored to the shoe upper, they anchor the plate 124 flush against the underside of the shoe upper 112. Preferably, plate 124 is provided with a jog 124*a* at the point of connection to shaft 122 so that the weld bead or headed connection 122*a* of the shaft to the plate can be a right-angle connection as shown in FIG. 6. Also as shown there, a notch 116*a* can be provided at the upper end of block 116 to provide clearance for jog 124*a***.

Positioned between the undersurface of plate 124 and the upper surface **116*b* of block 116 is a resilient compressive member 126 which has a central opening 126*a* to provide clearance for shaft 122 and jog 124*a*. That member is connected by a suitable bond 128 to the upper end 116*b* of block 116 and, via a similar bond 130, to the undersurface of plate 124 so that the block is anchored to the shoe upper 112, yet is permitted to move elastically and unidirectionally parallel to the axis of block passage 118** so as to obtain all of the benefits described above in connection with the other heel embodiments.

Preferably member 126 may be shaped and colored to blend in with the remainder of heel 110. Alternatively, it may be provided with a contrasting color coating similar to coating 104 (FIG. 5) so that a prospective customer can distinguish a shoe fitted with one of applicants' therapeutic heels from other shoes which do not possess the advantages enumerated above.

To permit the customer to vary or to adjust the stiffness or compressive characteristics of member 126, the member 126 may be supplied with the remainder of heel 110 as a separate member with peel and stick adhesive layers on its upper and lower surfaces. This allows the customer to select a member 126 of the appropriate stiffness when purchasing shoes equipped with heels 110.

Alternatively, a single member 126 may be provided which has holes or cutouts as shown in phantom at 134 in FIG. 7. In this event, the heel 118 or shoe would be sold with plugs shown in phantom at 136 in FIG. 7 which fit snugly in the holes 134. These plugs would have different stiffnesses or spring constants so that by inserting the appropriate plugs in holes 134, the pad as a whole can be designed to have compression characteristics suitable for the particular wearer. When the wearer is satisfied with the "feel" or compliance of the shoe equipped with a heel 110, she can strip away the backing strips from member 126 and positioned the member as shown in FIG. 6 so that when she steps on the heel, the member 126 will become firmly bonded to the heel block 116 and the heel plate 124. While such bonds anchor heel block 116 to the shoe upper 112, the heel block can still move unidirectionally and elastically as described above.

If for any reason the wearer desires to change the stiffness characteristics of heel 110 at a later date, the heel block 116 can be pulled away from plate 124 (with some considerable effort), after which the heel block surface **116*b* and the plate 124 can be cleaned so that a new compressive member 126 having a different stiffness characteristic can be incorporated into heel 110**. Such a change might be desirable, for example, if the wearer gains or loses appreciable weight.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings by interpreted as illustrative and not in a limiting sense.

It is also to be understood that the following claims are intended to cover all of the generic and specific features of the invention described herein.

We claim:

1. A heel for a shoe comprising an upper heel section, a lower heel section and resilient unidirectionally compressible means elastically connecting said sections so that the lower section can be moved only along a single motion axis relative to said upper section between a stable extended position and an unstable compressed position, said unidirectional compressible means including a shaft extending from one heel section, and being telescopically received in the other heel section, and a compressible resilient pad located adjacent to the upper end of the heel and connecting said heel sections together while permitting their relative motion only parallel to said shaft, and a wear-resistant heel surface for contacting the ground, said heel surface being spaced remotely from said pad.

2. The shoe defined in claim 1 and further including a shock-absorbing resilient pad of high friction material covering the upper surface of the shoe sole adjacent to the toe of the shoe.

3. The shoe defined in claim 1 and further including a resilient pad of high friction material covering the upper surface of the shoe sole in the region of the shoe arch.

4. The shoe defined in claim 1 and further including means for selecting the stiffness of the spring member.

5. The heel defined in claim 1 wherein said pad has one or more openings therein and a compressive plug received in at least said one opening, each of said plugs having a different stiffness from the remainder of said pad.

6. The shoe defined in claim 1 wherein said pad is externally marked to distinguish it as such.

7. The shoe defined in claim 1 wherein said pad is replaceable.

8. The shoe heel defined in claim 1 and further including means for varying the stiffness or compliance of said pad.

9. A shoe heel comprising an upper heel section, a lower heel section and unidirectionally compressible means elastically connecting said heel sections so that the lower section can move only along a single motion axis relative to said upper section between a stable extended position and an unstable compressed position, said means including a shaft having one end mounted to the upper heel section and extending telescopically into the lower heel section, and a compressible resilient pad located between and securing together said heel sections while permitting their relative motion only parallel to said shaft, and a wear-resistant heel surface mounted to the lower heel section relatively remote from said pad.

10. The shoe heel defined in claim 9 wherein said unidirectional compressible means include a relatively rigid plate umounted to said shaft one end and means for anchoring said plate to said upper heel section.

11. The shoe heel defined in claim 9 wherein said pad has at least one opening therein and a plug received in said one opening, said plug having a different stiffness from the remainder of said pad.

* * * * *